US006323589B1

(12) United States Patent
Inoue et al.

(10) Patent No.: US 6,323,589 B1
(45) Date of Patent: Nov. 27, 2001

(54) COLOR CATHODE RAY TUBE HAVING A SHADOW MASK OF IMPROVED STRENGTH

(75) Inventors: Masatsugu Inoue, Kumagaya; Norio Shimizu, Fukaya; Tadashi Ite, Himeji; Nobuhiko Akoh, Gumma-ken, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/255,697

(22) Filed: Feb. 23, 1999

(30) Foreign Application Priority Data

Feb. 23, 1998 (JP) ..... 10-040584
Sep. 17, 1998 (JP) ..... 10-263156

(51) Int. Cl.[7] ..... H01J 29/80
(52) U.S. Cl. ..... 313/402
(58) Field of Search ..... 313/402, 403, 313/404, 405, 407, 408

(56) References Cited

U.S. PATENT DOCUMENTS 4,099,086 * 7/1978 Roder et al ..... 313/407
4,327,307 * 4/1982 Penird et al. ..... 313/407
4,551,651 * 11/1985 Van Der Ven ..... 313/402
4,562,377 * 12/1985 Kamohara et al. ..... 313/407
6,051,918 * 4/2000 Hayashi et al. ..... 313/407

FOREIGN PATENT DOCUMENTS 6-349415 12/1994 (JP) .

* cited by examiner

*Primary Examiner*—Ashok Patel
*Assistant Examiner*—Todd Reed Hopper
(74) *Attorney, Agent, or Firm*—Oblon, Spivak, McClelland, Maier & Neustadt, P.C.

(57) ABSTRACT

A color cathode ray tube has a shadow mask. The shadow mask is composed of an almost rectangular mask body and an almost rectangular mask frame. The mask body has an effective surface facing a fluorescent screen, a non-aperture section surrounding the effective surface, and a bent skirt section formed on the periphery of the non-aperture section. The mask frame has a sidewall section provided on the skirt section of the mask body. In the shadow mask of such a configuration, a step section having a step in the direction perpendicular to the skirt section of the mask body is formed. With this configuration, the strength with which the curved surface of the effective surface of the shadow mask is enhanced, which prevents the color purity from deteriorating due to deformation and facilitates the formation of the shadow mask.

16 Claims, 5 Drawing Sheets

COLOR CATHODE RAY TUBE HAVING A SHADOW MASK OF IMPROVED STRENGTH

BACKGROUND OF THE INVENTION

This invention relates to a color cathode ray tube, and more particularly to a color cathode ray tube which alleviates the degradation of color purity due to the deformation of the shadow mask and facilitates the formation of the shadow mask.

Generally, a color cathode ray tube has a vacuum envelope composed of an almost rectangular panel 3 with a curved-surface effective region 1 on whose periphery a sidewall section 2 is provided, and a funnel 4 connected to the sidewall section 2 is provided, and a funnel 4 connected to the sidewall section 2. On the inside face of the effective region 1 of the panel 3, a fluorescent screen 5 is provided. The fluorescent screen 5 is composed of a black non-emitting layers and three-color fluorescent layers formed so as to fill up the spacing of the black non-emitting layer. Inside the fluorescent screen 5, an almost rectangular shadow mask 6 is provided on a mask frame, so as to face the fluorescent screen 5. The shadow mask 6 is supported in a detachable manner by elastic supports 8 hooked on stud pins 7 provided on the sidewall section 2 of the panel 3. In the neck 10 of the funnel 4, an electron gun 12 that emits three electron beams 11B, 11G, 11R is provided. The three electron beams 11B, 11G, 11R emitted from the electron gun 12 are deflected by a deflection unit 13 provided on the outside of the funnel 4 and directed toward the fluorescent screen 5 through the shadow mask 6. The three electron beams 11B, 11G, 11R scan the fluorescent screen 5 horizontally and vertically, thereby producing color images on the fluorescent screen 5.

The shadow mask 6 has the function of selecting the three electron beams 11B, 11G, 11R for the three-color fluorescent layers constituting the fluorescent screen 5 and landing the three electron beams 118, 11G, 11R on the corresponding three-color fluorescent layers. The shadow mask 6 is composed of an almost rectangular mask body 18 and a mask frame 20. As shown in FIGS. 2A and 2B, the mask body 18 is composed of an effective surface 15, a non-aperture section 16 enclosing the effective surface 15, and a bent skirt section 17 formed on the periphery of the non-aperture section 16 which has no through holes. The effective surface 15 is a curved surface, has a large number of electron beam through holes or apertures formed therein, for allowing the electron beams therethrough, and faces the fluorescent screen 5. The mask frame 20 has a sidewall section 19 provided on the skirt section 17 of the mask body 18.

In general, to display an image with a high color purity on the fluorescent screen 5 of the color cathode ray tube, the three electron beams 11B, 11G, 11R have to be selected by the electron beam through holes in the mask body 18 so that the three electron beams 11B, 11G, 11R may land on the three-color fluorescent layers properly. To do this, the positional relationship between the panel and shadow mask 6 needs to be maintained properly. The clearance (q value) between the inside face of the effective region 1 of the panel 3 and the effective surface 15 of the mask body 18 particularly has to be kept within specific permitted limits.

In recent years, to improve the visibility of color cathode ray tubes, effort has been directed toward making the radius of curvature of the outside face of the effective region 1 of the panel larger to bring the outside face close to a plane. In such a panel, the radius of curvature of the inside face of the effective region 1 also needs to be made larger from the viewpoints of the formation of the panel 3 and the visibility. With an increase in the radius of curvature of the inside face of the effective region 1, the radius of curvature of the effective surface 15 of the shadow mask 6 also needs to be made larger to achieve a suitable beam landing.

However, as the radius of curvature of the effective surface 15 of the shadow mask 6 is made larger, the strength with which the curved surface is retained decreases. As a result, a local deformation in manufacturing the shadow mask 6 or a thermal deformation in manufacturing the color cathode ray tube is liable to take place. This may cause a shift in the beam landing, making color purity liable to deteriorate. When the color cathode ray tube has been incorporated into a television set, the sound from the speaker is liable to cause the shadow mask 6 to resonate. The resonance may cause the deterioration (howling) of color purity.

To improve the strength with which the curved surface of the shadow mask 6 is retained, a method of providing a reinforcing bead on the effective surface has been disclosed in Jpn. Pat. Appln. KOKAI Publication No. 7-161306.

However, when a reinforcing bead has been provided on the effective surface with a larger radius of curvature to produce a sufficient curved-surface retaining strength, the spacing between the inside face of the effective region of the panel and the effective surface of the shadow mask falls locally away from the permitted limits. This permits an image of a step caused by the formation of the reinforcing bead to appear on the screen, degrading the picture quality seriously. For this reason, there is a limit to the height of the reinforcing bead. Usually, the limit ranges from about 0.1 to 0.2 mm, which causes the problem of being unable to make the curved-surface retaining strength sufficiently high.

As described above, to improve the visibility of a color cathode ray tube, the radius of curvature of the outside face of the effective region of the panel is made larger to bring the outside face close to a plane. This also requires the radius of curvature of the inside face of the effective region to be made larger. As a result, the radius of curvature of the effective surface of the shadow mask has to be made larger. Making the radius of curvature of the effective surface larger decreases the curved-surface retaining strength.

As a result, a local deformation in manufacturing a shadow mask or a thermal deformation in manufacturing a color cathode ray tube is liable to take place. This may cause a shift in the beam landing and the deterioration of color purity. When the color cathode ray tube has been incorporated into a television set, the sound from the speaker is liable to cause the shadow mask to resonate. The resonance may degrade the color purity.

To improve the strength with which the effective surface of the mask body with a larger radius of curvature is retained, a method of providing a reinforcing bead on the effective surface has been proposed. When a reinforcing bead has been provided on the effective surface with a larger radius of curvature to produce a sufficient curved-surface retaining strength, the spacing between the inside face of the effective region of the panel and the effective surface of the mask body falls locally away from the permitted limits. This permits an image of a step caused by the formation of the reinforcing bead to appear on the screen, seriously degrading the picture quality. For this reason, the curved-surface retaining strength cannot be made sufficiently high by use of a reinforcing bead in a shadow mask whose effective surface has a larger radius of curvature.

BRIEF SUMMARY OF THE INVENTION

The object of the present invention is to provide a color cathode ray tube which heightens the curvedsurface retaining strength of the effective surface of a shadow mask to prevent color purity from deteriorating as a result of the deformation of the shadow mask and facilitate the formation of the shadow mask.

(1) In a color cathode ray tube of the present invention, an almost rectangular shadow mask is provided so as to face a fluorescent screen formed on the inside face of a rectangular panel on whose periphery a sidewall section is provided, the shadow mask being composed of an almost rectangular mask body and an almost rectangular mask frame, the mask body having an effective surface in which a large number of electron beam through holes are made and which faces the fluorescent screen, a non-aperture section enclosing the effective surface, and a bent skirt section formed on the periphery of the non-aperture section, and the mask frame having a sidewall section to be provided on the skirt section of the mask body, and a step section is formed which has a step at the skirt section of the mask body in the direction perpendicular to the axis of the tube.

(2) In a color cathode ray tube of the present invention, an almost rectangular shadow mask is provided so as to face a fluorescent screen formed on the inside face of an almost rectangular panel on whose periphery a sidewall section is provided, the shadow mask being composed of an almost rectangular mask body and an almost rectangular mask frame, the mask body having an effective surface in which a large number of electron beam through holes are made and which faces the fluorescent screen, a non-aperture section enclosing the effective surface, and a bent skirt section formed on the periphery of the non-aperture section, and the mask frame having a sidewall section to be provided on the skirt section of the mask body, the boundary between the non-aperture section of the mask body and the skirt section is made closer to the fluorescent screen than the boundary between the effective surface and the non-aperture section, and a step section having a step in the direction perpendicular to the axis of the tube is formed at the bent skirt section formed on the periphery of the non-aperture section.

(3) In the color cathode ray tube in item (1) or (2), the step section is formed continuously in the direction perpendicular to the direction of width of the skirt section.

(4) In the color cathode ray tube in item (1) or (2), the step section is formed discontinuously in the direction perpendicular to the direction of width of the skirt section.

(5) In the color cathode ray tube in item (3) or (4), the height of the step in the step section is set to 1 to 10 mm.

(6) In the color cathode ray tube in any one of items (1) to (5), the step section is formed near the boundary between the skirt section and the non-aperture section.

(7) In the color cathode ray tube in any one of items (1) to (6), the step section is formed at the skirt section at least on either the long sides or the short sides of the mask body.

(8) In the color cathode ray tube in item (7), the size of the step section is changed according to a position on the skirt section.

(9) In the color cathode ray tube in item (7), the size of the step section on the long sides of the mask body differs from that on the short sides.

(10) In a color cathode ray tube of the present invention, an almost rectangular shadow mask is provided so as to face a fluorescent screen formed on the inside face of an almost rectangular panel on whose periphery a sidewall section is provided, the shadow mask being composed of an almost rectangular mask body and an almost rectangular mask frame, the mask body having an effective surface in which a large number of electron beam through holes are made and which faces the fluorescent screen, a non-aperture section enclosing the effective surface, and a bent skirt section formed on the periphery of the non-aperture section, and the mask frame having a sidewall section to be provided on the skirt section of the mask body, and a step section having a step in the direction perpendicular to the axis of the tube and slits are formed at the skirt section of the mask body.

(11) In a color cathode ray tube of the present invention, an almost rectangular shadow mask is provided so as to face a fluorescent screen formed on the inside face of an almost rectangular panel on whose periphery a sidewall section is provided, the shadow mask being composed of an almost rectangular mask body and an almost rectangular mask frame, the mask body having an effective surface in which a large number of electron beam through holes are made and which faces the fluorescent screen, a non-aperture section enclosing the effective surface, and a bent skirt section formed on the periphery of the non-aperture section, and the mask frame having a sidewall section to be provided on the skirt section of the mask body, the boundary between the non-aperture section of the mask body and the skirt section is made closer to the fluorescent screen than the boundary between the effective surface and the non-aperture section, and a step section having a step in the direction perpendicular to the axis of the tube and slits are formed at the bent skirt section formed on the periphery of the non-aperture section.

(12) In the color cathode ray tube in item (10) or (11), the step section is formed discontinuously in the direction perpendicular to the direction of width of the skirt section near the boundary between the skirt section and the non-aperture section and the slits are made in the edge of the skirt section in the portions where the step section has and has not been formed.

(13) In the color cathode ray tube in any one of items (10) to (12), the length of the slits is made about one-half the width of the skirt section.

(14) In the color cathode ray tube, an almost rectangular shadow mask is provided so as to face a fluorescent screen formed on the inside face of an almost rectangular panel on whose periphery a sidewall section is provided, the shadow mask being composed of an almost rectangular mask body and an almost rectangular mask frame, the mask body having an effective surface in which a large number of electron beam through holes are made and which faces the fluorescent screen, a non-aperture section enclosing the effective surface, and a bent skirt section formed on the periphery of the non-aperture section, and the mask frame having a sidewall section to be provided on the skirt section of the mask body, and a step section having a step in the direction perpendicular to the axis of the tube, which is formed near a welding portion between the mask boy and the bent skirt.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Hereinafter, referring to the accompanying drawings, embodiments of the present invention will be explained.

Figure 1:
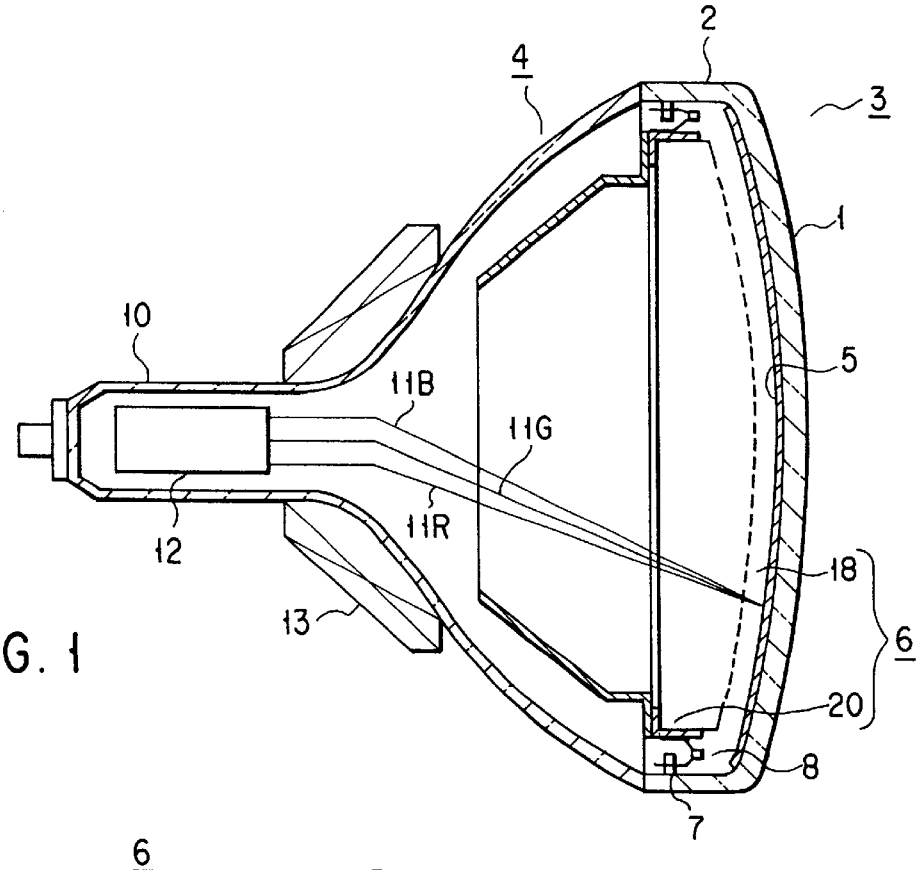
FIG. 1 is a schematic sectional view illustrating a general configuration of a conventional color cathode ray tube.
Figure 2A:
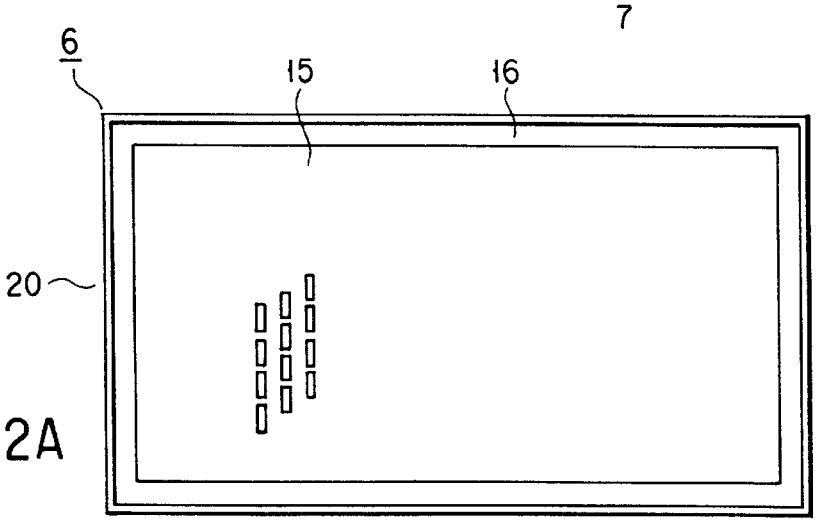
FIG. 2A is a schematic plan view illustrating the structure of the shadow mask in the conventional color cathode ray tube of FIG. 1.
Figure 2B:
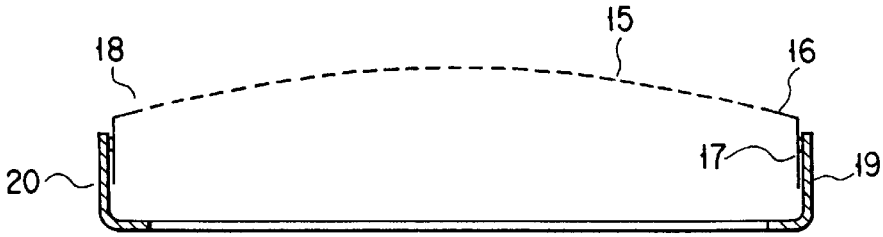
FIG. 2B is a schematic sectional view illustrating the structure of the shadow mask in the conventional color cathode ray tube of FIG. 1.
Figure 3:
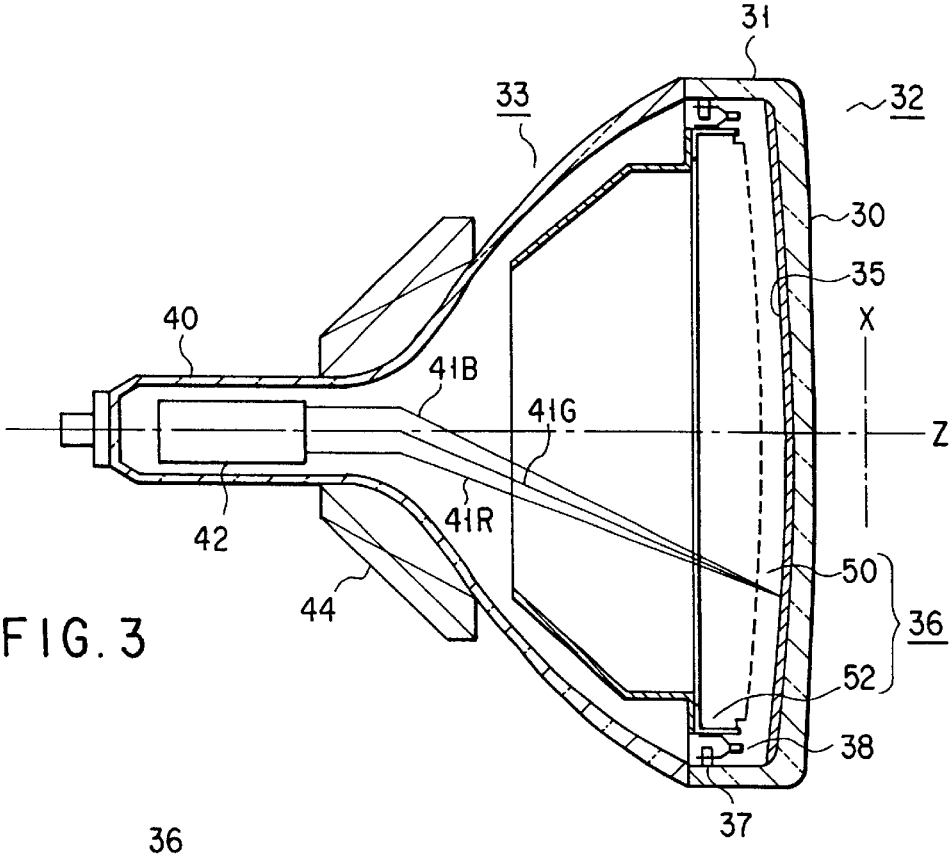
FIG. 3 is a schematic sectional view illustrating the configuration of a color cathode ray tube according to an embodiment of the present invention.

FIG. 3 shows a color cathode ray tube according to an embodiment of the present invention. The color cathode ray tube has an almost rectangular panel 32 on the periphery of whose effective region 30 a sidewall section 31 is provided. A funnel 33 connected to the sidewall section 31 and the panel 32 constitute a vacuum envelope. The inside face of the effective region 30 of the panel 32 is flat or slightly curved. Its inside face takes the form of a curved surface with a larger radius of curvature than that of the inside face of the effective surface of a conventional panel. Namely, the panel 32 is a flattened panel.

On the inside face of the effective region 30 of the panel 32, a fluorescent screen 35 is provided. The fluorescent screen 35 is composed of black non-emitting layers called black stripes, and three-color fluorescent layers provided so as to fill out the spacing of the black non-emitting layer. The three-color fluorescent layer emits blue, green, and red rays of light. Inside the fluorescent screen 35, an almost rectangular shadow mask 36 is provided so as to face the fluorescent screen 35. Stud pins 37 are provided on the sidewall section 31 of the panel 32. A wedge-shaped elastic support 38 is provided on the sidewall section of each corner of the frame of the shadow mask 36. The wedge-shaped elastic supports 38 are hooked on the stud pins 37, thereby enabling the panel 32 to support the shadow mask 36 in a detachable manner. Inside the neck 40 of the funnel 33, an electron gun 42 that emits three electron beams 41B, 41G, 41R is provided.

The three electron beams 41B, 41G, 41R emitted from the electron gun 42 are deflected by a magnetic field caused by a deflection unit 44 provided on the outside of the funnel 33 and directed to the fluorescent screen 35 through the shadow mask 36. The three electron beams 41B, 41G, 41R then scan the fluorescent screen 35, thereby producing color images on the fluorescent screen 35.

Figure 4A:
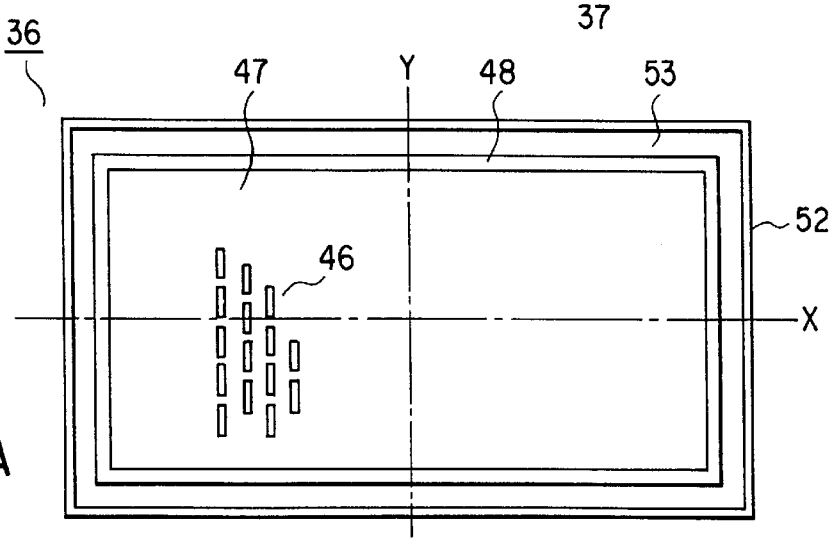
FIG. 4A is a schematic plan view illustrating the structure of the shadow mask in the color cathode ray tube of FIG. 3.
Figure 4B:
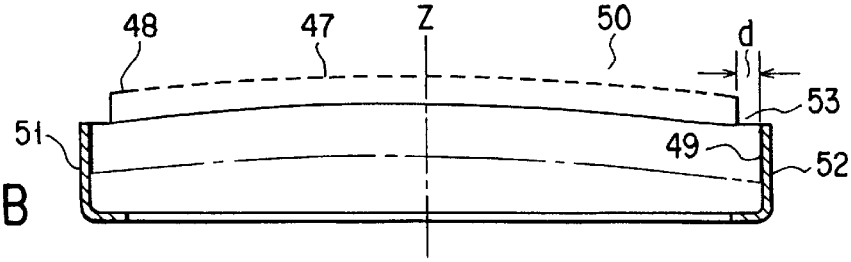
FIG. 4B is a schematic sectional view illustrating the structure of the shadow mask in the color cathode ray tube of FIG. 3.

As shown in FIGS. 4A and 4B, the shadow mask 36 is composed of an almost rectangular mask body 50 and an almost rectangular mask frame 52. The mask body 50 has an effective surface 47 composed of a curved surface facing the fluorescent screen and a non-aperture section 48 provided so as to surround the periphery of the effective surface 47. In the effective surface 47, a large number of electron beam through holes 46 are made. On the periphery of the non-aperture section 48, a bent skirt section 49 is formed. The mask frame 52 has a sidewall section 51 on the inside of which the skirt section 49 of the mask body 50 is provided.

In the embodiment, as shown in FIG. 4B, at the boundary between the skirt section 49 of the mask body 50 and the non-aperture section 48, there is provided a step section 53 stepped in the direction of width, i.e., height (the direction of Z) of the skirt section 49 and extended in the direction (the directions of X and Y) perpendicular to the direction of width (the direction of Z). The open end of the skirt section 49 where the step section 53 has not been formed is welded to the mask frame 51. The step section 53 is formed continuously around all the circumference of the skirt section 49 so as to enclose the effective surface 47. The lateral length d of the step in the direction (the directions of X and Y) perpendicular to the tube axis (Z-axis) is set to 1 to 10 mm.

The step section 53 of the mask body 50 can be easily formed at the same time that a flat-plate mask in which electron beam through holes have been made by photoetching is press-molded.

When the step section 53 is provided at the boundary between the skirt section 49 of the mask body 50 and the non-aperture section 48, the strength of the skirt section 49 is increased by the plastic deformation caused by forming the skirt section 49 by press molding. This improves the strength with which the curved surface of the effective surface is retained. The step section 53 can absorb deforming stress in manufacturing a shadow mask or thermal deforming stress in manufacturing a color cathode ray tube, thereby preventing the effective surface 47 from being deformed. Furthermore, when a color cathode ray tube is incorporated into a television set, the improvement of the curved-surface retaining strength makes the sound from the speaker less liable to cause resonance. Therefore, use of the step section 53 makes the color cathode ray tube less liable to permit color purity to deteriorate.

For instance, as a result of providing a step with d=4 mm for the skirt section in a shadow mask incorporated in a color cathode ray tube with a 76-cm-long diagonal, it has been verified that the movement of the beam landing on the three-color fluorescent layer caused by the speaker sound resonance was reduced about 50%.

The reason why the length d of the step in the step section 53 in the direction perpendicular to the axis of the tube was set to 1 to 10 mm is that use of the length d less than 1 mm cannot improve the curved surface retaining strength for the effective surface 47 effectively. Another reason is that when the length d exceeds 10 mm, not only is a balance between the outside diameter of the shadow mask and the dimensions of the effective surface lost for practical use, but also the effect of improving the curved-surface retaining strength of the effective surface 47 decreases.

Next, a shadow mask according to another embodiment of the present invention will be explained. The shadow mask of this embodiment differs in structure from the shadow mask shown in FIGS. 4A and 4B.

Figure 5A:
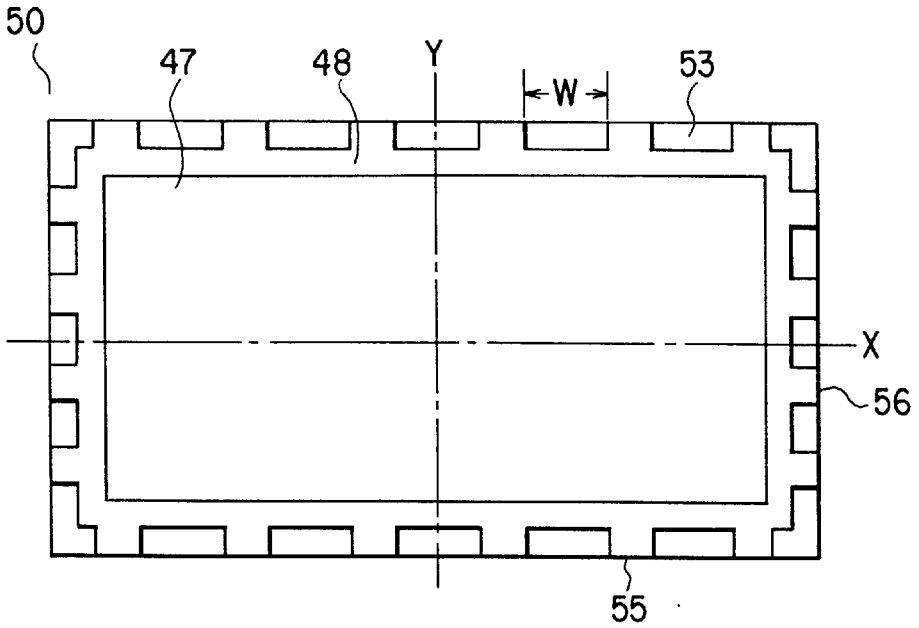
FIG. 5A is a schematic plan view illustrating the structure of the mask body of a shadow mask according to another embodiment of the present invention, which differs in structure from the shadow mask shown in FIGS. 4A and 4B.
Figure 5B:
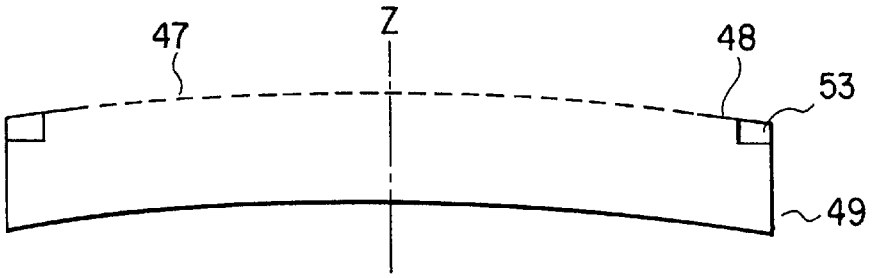
FIG. 5B is a schematic front view illustrating the structure of the mask body of the shadow mask of FIG. 5A.

In the embodiment shown in FIGS. 4A and 4B, the step section has been formed continuously around all the circumference of the skirt section in such a manner that the step section encloses the effective surface. In a mask body 50 shown in FIGS. 5A and 5B, a plurality of discontinuous step sections 53 are formed in the direction of width of the skirt section 49 at the boundary between the skirt section 49 and non-aperture section 48. Each step section 53 is extended in the direction perpendicular to the direction of the width. In a sectional view of the step section 53 taken in the direction perpendicular to the axis of the tube as shown in FIG. 5A, portions where the step sections 53 have been formed alternate with portions where no step section 53 has been formed in such a manner that they enclose the effective surface 47.

In the present embodiment, the width w (size) of the step section 53 in the direction (the directions of X and Y) perpendicular to the direction (the direction of Z) of the width of the skirt section 49 and the spacing between the step sections 53 on the long sides 57 differ from those on the short sides 56. The width of the step section 53 and the spacing between the step sections on the short sides 56 are smaller than those on the long sides 57.

When the step section 53 are provided discontinuously this way, the strength of the skirt section 49 is made higher by a plastic deformation caused by forming the skirt section 49 by press molding than that of the mask body shown in FIGS. 4A and 4B. This improves the curved-surface retaining strength of the effective surface 47 more effectively, making the color cathode ray tube less liable to permit color purity to deteriorate.

While in the above embodiments, the step section has been provided on both of the long sides and short sides in such a manner that the step sections enclose the effective surface of the mask body, the step section may be provided on only either the long sides or the short sides. This would improve the curved-surface retaining strength of the effective surface. Specifically, the curved-surface retaining strength of the effective surface can be improved in a well-balanced manner by just forming selectively step sections in portions where the curved-surface retaining strength of the effective surface is liable to decrease. This approach produces a similar effect to that of the above embodiments.

Continuous step sections may be combined with discontinuous step sections in such a manner that, for example, continues step sections are provided on the short sides and discontinuous step sections are provided on the long sides.

Furthermore, the width w of the step sections may be changed on a single side and the spacing between the step sections be variable there.

In the above embodiments, the effective surface of the mask body and the non-aperture section enclosing the periphery of the effective surface are made up of a continuous plane. In the mask body 50 shown in FIG. 6, the boundary between the non-aperture section 48 and the skirt section 49 is formed by bending the non-aperture section 48 at a place close to the effective surface 47 in such a manner that the boundary between the non-aperture section 48 and skirt section 49 projects higher than the boundary between the effective surface 47 and the non-aperture section 48 toward the fluorescent screen. The step sections 53 are provided at the boundary between the non-aperture section 48 and the skirt section 49.

With the mask body 50 constructed as described above, the non-aperture section 48 functions as a bead that improves the curved-surface retaining strength of the effective surface 47. The non-aperture section 48, together with the step sections 53, further improves the curved-surface retaining strength of the effective surface 47, which enables the construction of a color cathode ray tube less liable to permit color purity to deteriorate.

Figure 7A:
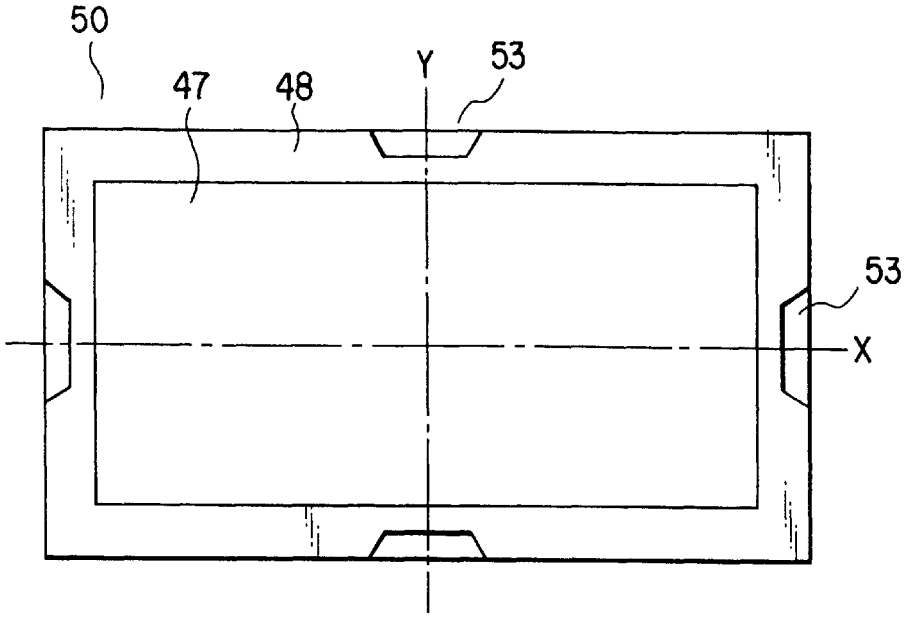
FIG. 7A is a schematic plan view illustrating the structure of the mask body of a shadow mask according to another embodiment of the present invention, which differs from the above shadow mask.
Figure 7B:
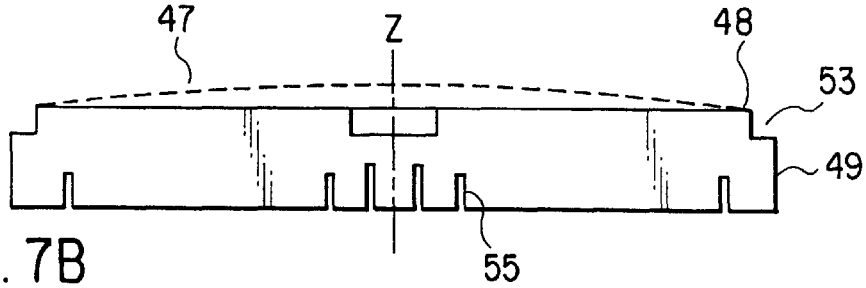
FIG. 7B is a schematic front view illustrating the structure of the mask body of the shadow mask of FIG. 7A.

Furthermore, in the mask body 50 shown in FIGS. 7A and 7B, a non-aperture section 48 is provided on the periphery of the effective surface 47 in such a manner that the non-aperture section has a continuous surface with the effective surface 47. The bent skirt section 49 is formed on the periphery of the non-aperture section 48. In the mask body 50, the step sections 53 are provided particularly at the boundary between the skirt section 49 and the non-aperture section. Slits 55 are made in the skirt section 49.

The step sections 53 are provided at the boundary between the skirt section 49 and non-aperture section 48 on the horizontal axis (X-axis) and the vertical axis (Y-axis). In contrast, the slits 55 are made in the portions where the step sections 53 have and have not been formed on the open end side of the skirt section. The length of the slit 55 in the direction of width of the skirt section 49 is set to be not larger than one-half the width of the skirt section 49, usually to the length ranging from 5 to 20 mm.

Figure 8:
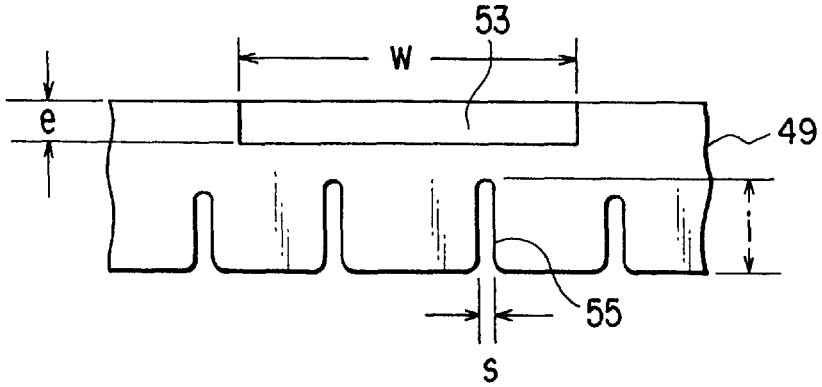
FIG. 8 shows the structure of the important portion of the mask body in FIG. 7A.

For example, in a shadow mask incorporated in a color cathode ray tube with a 68-cm-long diagonal, the length d of the step section 53 in the direction perpendicular to the axis of the tube is set to 3 mm, its depth e in the direction of width of the skirt section 49 is 5 mm, and its width w in the direction perpendicular to the direction of width of the skirt section 49 is 130 mm as shown in FIG. 8. In a flat-plate mask of FIG. 9, slits 55 with a length of 12 mm and a width w of 1.6 mm are made in positions 70 mm and 230 mm from the vertical axis on the open edge side of the skirt section 49 in the portions where the step sections 53 have been formed on the long and short sides, and on the long sides. On the short sides, such slits are made in positions 80 mm and 150 mm from the horizontal axis.

Figure 9:
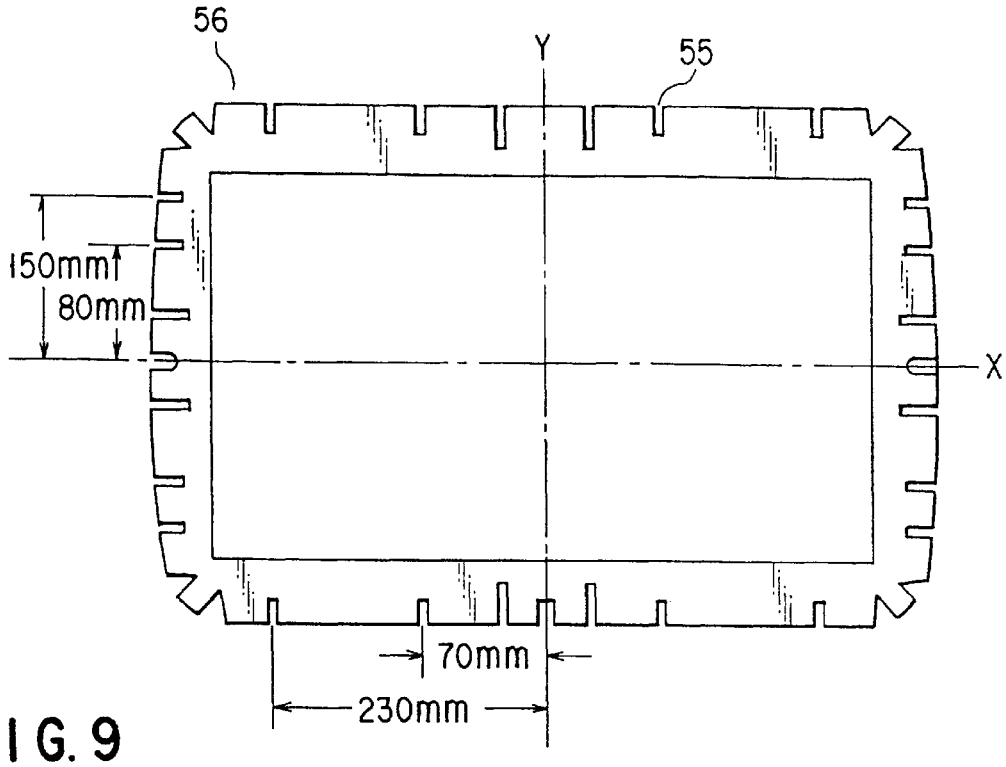
FIG. 9 shows the structure of a flat-plate mask before the formation of the mask body shown in FIG. 7A.

Such a mask body 50 is formed as follows. As shown in FIG. 9, when a flat-plate mask 56 is formed by photoetching, slits 55 are made at the same time when electron beam through holes are made. Thereafter, when step sections are molded at the same time the flat plate mask 56 is press-molded, the mask body 50 is thereby formed.

When the step sections 53 and slits 55 are provided at the skirt section 49 of the mask body 50 as described above, the curved-surface retaining strength of the effective surface 47 improves. Furthermore, the step sections 53 absorb deforming stress in manufacturing a shadow mask or thermal deforming stress in manufacturing a color cathode ray tube, preventing the effective surface 47 from being deformed. Moreover, resonance caused by sound from a speaker is less liable to take place, which makes the color cathode ray tube less liable to permit color purity to deteriorate. In addition, the configuration facilitates the assembly of the shadow mask.

Specifically, when the step sections 53 are provided on the skirt section 49 of the mask body 50, wrinkles or nodules occur near the step sections 53 in press molding, which widens the open edge side of the skirt section 49, making it difficult to insert the skirt section 49 inside the sidewall of the mask frame. As in the mask body 50, however, when slits 55 are made suitably in the portions where the step sections 53 have and have not been formed on the open edge side of the skirt section 49, the slits 55 absorb wrinkles or nodules caused by the formation of the step sections 53 in press molding. This prevents the skirt section 49 from spreading on the open edge side, making it easier to insert the skirt section 49 inside the sidewall of the mask frame.

In the mask body shown in FIGS. 7A and 7B, the step sections have been provided only near the boundary between the skirt section and the non-aperture section in the vicinity of the horizontal axis and vertical axis, and slits have been made in the skirt section. Similarly, making suitable slits in the skirt section in the following cases would produce similar effects: a case where a step section is formed continuously around all the circumference of the skirt section so as to enclose the effective surface; a case where plural step sections are formed discontinuously in the direction perpendicular to the axis of the skirt section and the width of the step section in the direction perpendicular to the direction of width of the skirt section and the spacing of the step sections on the long sides differ from those on the short sides; or a case where a continuous step section is combined with discontinuous step sections.

Figure 6:
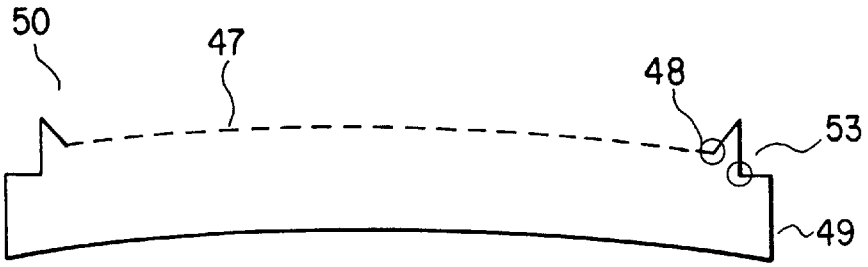
FIG. 6 is a schematic front view illustrating the structure of the mask body of a shadow mask according to another embodiment of the present invention, which differs from the shadow mask shown in FIGS. 4A and 4B or FIGS. 5A and 5B.

In FIGS. 7A and 7B, the mask body has a continuous surface constituting both the effective surface of the mask body and the non-aperture section enclosing the periphery of the effective surface. Alternatively, applying the invention to a mask body where the boundary between the non-aperture section and the skirt section is projected higher than the boundary between the effective surface and the non-aperture section toward the fluorescent screen by bending the non-aperture section at a place close to the effective surface, as shown in FIG. 6, would produce a similar effect.

Figure 10A:
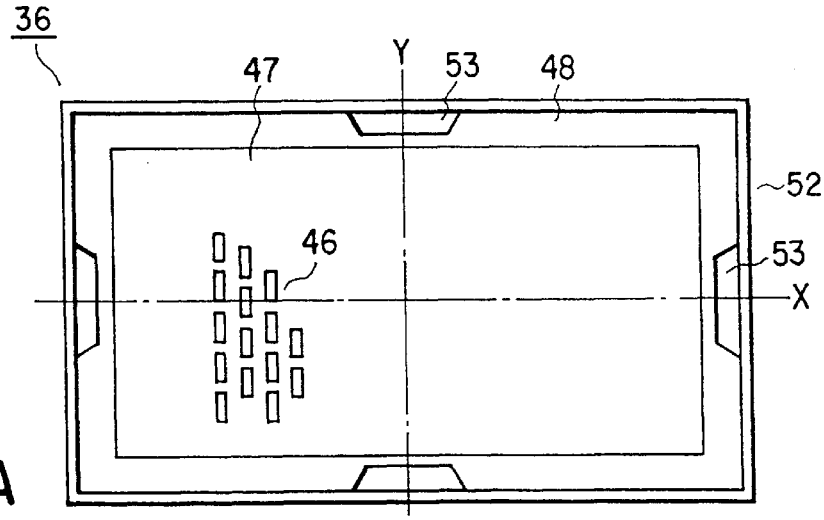
FIG. 10A is a schematic plan view illustrating the structure of a shadow mask according to another embodiment of the present invention, which differs from the above shadow mask.
Figure 10B:
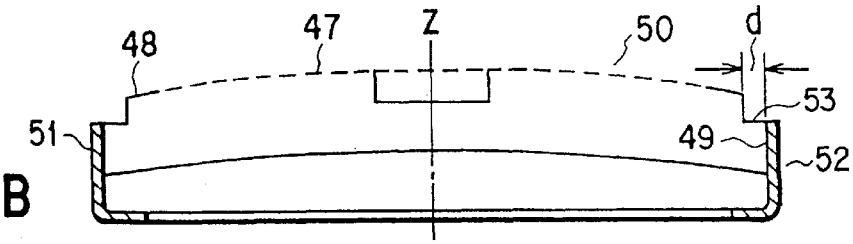
FIG. 10B is a schematic sectional view illustrating the structure of the shadow mask of FIG. 7A.

Furthermore, the step section and the sections associated with the step section may have a stricture as shown in FIGS. 10A and 10B. The shadow mask 36 is composed of an almost rectangular mask body 50 and an almost rectangular mask frame 52. The mask body 50 has an effective surface 47 composed of a curved surface facing the fluorescent screen and a non-aperture section 48 provided so as to surround the periphery of the effective surface 47. In the effective surface 47, a large number of electron beam through holes 46 are made. On the periphery of the non-aperture section 48, a bent skirt section 49 is formed. The mask frame 52 has a sidewall section 51 on the inside of which the skirt section 49 of the mask body 50 is provided.

In the embodiment, as shown in FIG. 10B, at the boundary between the skirt section 49 of the mask body 50 and the non-aperture section 48, there is provided a step section 53 stepped in the direction of width, i.e., height (the direction of Z) of the skirt section 49 and extended in the direction (the directions of X and Y) perpendicular to the direction of width (the direction of Z). The open end of the skirt section 49 where the step section 53 has been formed is welded to the mask frame 51. The step sections 53 are formed at several parts on the skirt section 49 so as to enclose the effective surface 47. The lateral length d of the step in the direction (the directions of X and Y) perpendicular to the tube axis (Z-axis) is set to 1 to 10 mm.

The step section 53 of the mask body 50 can be formed easily at the same time when a flat-plate mask in which electron beam through holes have been made by photoetching is press-molded.

When the step section 53 is provided at the boundary between the skirt section 49 and the non-aperture section 48 of the mask body 50 and near to a welding portion for fixing the mask frame 50 to the skirt section 49, the strength of the skirt section 49 is increased by the plastic deformation caused by forming the skirt section 49 by press molding. This improves the strength with which the curved surface of the effective surface is retained. The step section 53 can absorb deforming stress in manufacturing a shadow mask or thermal deforming stress in manufacturing a color cathode ray tube, which is applied through the welding section, thereby preventing the effective surface 47 from being deformed. Furthermore, when a color cathode ray tube is incorporated into a television set, the improvement of the curved-surface retaining strength makes sound from a speaker less liable to cause resonance. Therefore, use of the step section 53 makes the color cathode ray tube less liable to permit color purity to deteriorate.

Furthermore, to improve the strength of the effective surface 47, it is preferable to provide step sections 53 at the boundary in the directions (X and Y directions) perpendicular to the tube axis (Z axis). It is more preferable that the step sections are provided near the welding portions between the skirt section and the mask body, and non-step sections are provided between the step sections and the step section and non-step sections are alternatively arranged around the periphery of the effective surface 47 instead of proving the continuous elongated step around the periphery of the effective region. The combination of the step sections formed near to the welding sections and non-step sections arranged between the step sections further improve the strength of the effective surface 47.

For instance, it has been verified that the movement of the beam landing on the three-color fluorescent layer caused by the resonance of sound from a speaker was reduced about 50%, as a result of providing the steps having same dimension with step length d=4 mm, the elongated length of 140 mm along the X and Y directions and the height of 5 mm along the Z direction for the skirt section in a shadow mask incorporated in a color cathode ray tube with a 76 cm-long diagonal.

The reason why the length d of the step in the step section 53 in the direction perpendicular to the axis of the tube was set to 1 to 10 mm is that use of the length d less than 1 mm cannot improve the curved surface retaining strength for the effective surface 47 effectively. Another reason is that when the length d exceeds 10 mm, not only is a balance between the outside diameter of the shadow mask and the dimensions of the effective surface lost for practical use, but also the effect of improving the curved-surface retaining strength of the effective surface 47 decreases. If the step length of the step section is set to be large, the improvement of the strength may be deteriorated. In consideration of the improvement of the strength, it was found that the step length d of the step section is set to be within about 160 mm.

In the above embodiments, a color cathode ray tube with a panel having a flattened effective region has been used. Alternatively, applying the invention to a shadow mask in an ordinary color cathode ray tube with a panel the inside and outside faces of whose effective region are composed of curved surfaces with relatively large radii of curvature would produce a similar effect.

As described above, providing the step sections on the skirt section of the mask body of the shadow mask increases the strength of the skirt section and thereby improves the curved-surface retaining strength of the effective surface. The step sections absorb deforming stress in manufacturing a shadow mask or thermal deforming stress in manufacturing a color cathode ray a tube, preventing the effective surface from being deformed. When the color cathode ray tube has been incorporated into a television set, resonance caused by sound from a speaker is less liable to occur. Therefore, by constructing a cathode ray tube as described above, the color cathode ray tube is less liable to permit color purity to deteriorate. Furthermore, the effective region of the panel is particularly flattened. Therefore, applying the invention to a color cathode ray rube in which the effective surface of the mask body of the shadow mask has been flattened would produce great improvement.

Furthermore, making slits in the skirt section enables wrinkles or nodules aggravated by the formation of the step sections to be absorbed, which prevents the skirt section from spreading on the open edge side, facilitating the assembly of a shadow mask.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube having a tube axis comprising:

an almost rectangular panel having a rectangular effective region and a sidewall section provided on the periphery of the effective region;

a fluorescent screen formed on the inside face of the panel; and an almost rectangular shadow mask which is provided so as to face the fluorescent screen and which is composed of an almost rectangular mask body and a mask frame, the mask body having an effective surface in which a large number of electron beam through holes are made and which faces the fluorescent screen, a non-aperture section surrounding the effective surface, a bent skirt section formed on the periphery of the non-aperture section, and a projecting section at the boundary between the non-aperture section and the skirt section which projects higher than the boundary between the effective surface and the non-aperture section toward the fluorescent screen, the projecting section having a first part continuously extending from the periphery of the non-aperture section toward the fluorescent screen, a second part continuously extending from the first part so as to be substantially in parallel with the skirt section and a third part continuously extending from the second part so as to be substantially perpendicular to the second part and to connect the second part to the skirt section, and the mask frame having a sidewall section to be provided on the skirt section of the mask body, wherein the step section is formed discontinuously in the direction perpendicular to the direction of width of the skirt section.

2. A color cathode ray tube according to claim 1, wherein the step section is extended continuously in the direction perpendicular to the direction of width of the skirt section.

3. A color cathode ray tube according to claim 1, wherein the length of the step in the step section in the direction perpendicular to the axis of the tube is set to 1 to 10 mm.

4. A color cathode ray tube according to claim 1, wherein the step section is provided at least on either the long sides or the short sides of the mask body.

5. A color cathode ray tube according to claim 1, wherein the size of the step section differs according to a position on the skirt section.

6. A color cathode ray tube according to claim 1, wherein the size of the step section on the long sides of the mask body differs from that on the short sides.

7. A color cathode ray tube having a tube axis comprising:

an almost rectangular panel having a rectangular effective region and a sidewall section provided on the periphery of the effective region;

a fluorescent screen formed on the inside face of the panel;

an almost rectangular shadow mask which is provided so as to face the fluorescent screen and which is composed of an almost rectangular mask body and a mask frame, the mask body having an effective surface in which a large number of electron beam through holes are made and which faces the fluorescent screen, a non-aperture section surrounding the effective surface, and a bent skirt section formed on the periphery of the non-aperture section and having slits, and the mask frame having a sidewall section to be provided on the skirt section of the mask body; and a step section which is stepped along the tube axis at the boundary between the skirt section of the mask body and the non-aperture section of the mask body, and having a first region continuously extending from the periphery of the non-aperture section so as to be substantially in parallel with the skirt section and a second region continuously extending from the first region so as to be substantially perpendicular to the first region and to connect the first region to the skirt section, wherein each of the step sections is extended in the direction perpendicular to the direction of width of the skirt section at the boundary between the skirt section and the non-aperture section and the slits are formed at the open edge side of the skirt section.

8. A color cathode ray tube according to claim 7, wherein the step section is formed continuously in the direction perpendicular to the direction of width of the skirt section.

9. A color cathode ray tube according to claim 7, wherein the length of the step in the step section in the direction perpendicular to the axis of the tube is set to 1 to 10 mm.

10. A color cathode ray tube according to claim 7, wherein the step section is formed at the skirt section at least on either the long sides or the short sides of the mask body.

11. A color cathode ray tube according to claim 7, wherein the size of the step section differs according to a position on the skirt section.

12. A color cathode ray tube according to claim 7, wherein the size of the step section on the long sides of the mask body differs from that on the short sides.

13. A color cathode ray tube having a tube axis comprising:

an almost rectangular panel having a rectangular effective region and a sidewall section provided on the periphery of the effective region;

a fluorescent screen formed on the inside face of the panel;

an almost rectangular shadow mask which is provided so as to face the fluorescent screen and which is composed of an almost rectangular mask body and a mask frame, the mask body having an effective surface in which a large number of electron beam through holes are made and which faces the fluorescent screen, a non-aperture section surrounding the effective surface, and a bent skirt section formed on the periphery of the non-aperture section and having slits, and the mask frame having a sidewall section to be provided on the skirt section of the mask body; and a step section which is stepped along the tube axis at the boundary between the skirt section of the mask body and the non-aperture section of the mask body, and having a first region continuously extending from the periphery of the non-aperture section so as to be substantially in parallel with the skirt section and a second region continuously extending from the first region so as to be substantially perpendicular to the first region and to connect the first region to the skirt section, wherein each of the step sections is extended in the direction perpendicular to the direction of width of the skirt section at the boundary between the skirt section and the non-aperture section and the slits are formed at the open edge side of the skirt section, wherein each of the step sections is extended in the direction perpendicular to the direction of width of the skirt section at the boundary between the skirt section and the non-aperture section, the skirt section includes an open edge side where step sections have and have not been formed, and the slits are formed at the open edge side of the skirt section portions where the step sections have and have not been formed.

14. A color cathode ray tube according to claim 13, wherein the length of the slits is made about one-half the width of the skirt section.

15. A color cathode ray tube comprising:

an almost rectangular panel having a rectangular effective region and a sidewall section provided on the periphery of the effective region;

a fluorescent screen formed on the inside face of the panel;

an almost rectangular shadow mask which is provided so as to face the fluorescent screen and which is composed of an almost rectangular mask body and a mask frame, the mask body having an effective surface in which a large number of electron beam through holes are made and which faces the fluorescent screen, a non-aperture section surrounding the effective surface, a bent skirt section formed on the periphery of the non-aperture section, and the mask frame having a sidewall section to be provided on the skirt section of the mask body, wherein the mask body has a projecting section at the boundary between the non-aperture section and the skirt section which is projected higher than the boundary between the effective surface and the non-aperture section toward the fluorescent screen, the projecting section having a first part continuously extending from the periphery of the non-aperture section toward the fluorescent screen, a second part continuously extending from the first part so as to be substantially in parallel with the skirt section and a third part continuously extending from the second part so as to be substantially perpendicular to the second part and to connect the second part to the skirt section, and the bent skirt section formed at the boundary between the non-aperture section and the skirt section, which have a first region continuously extending from the periphery of the non-aperture section so as to be substantially in parallel with the skirt section and a second region continuously extending from the first region so as to be substantially perpendicular to the first region and to connect the first region to the skirt section, wherein each of the step sections is extended in the direction perpendicular to the direction of width of the skirt section at the boundary between the skirt section and the non-aperture section, the skirt section includes an open edge side where step sections have and have not been formed, and the slits are formed at the open edge side of the skirt section portions where the step sections have and have not been formed.

16. A color cathode ray tube according to claim 15, wherein the length of the slits is made about one-half the width of the skirt section.

* * * * *